United States Patent [19]

Nishikawa et al.

[11] 4,245,198

[45] Jan. 13, 1981

[54] HIGH FREQUENCY FILTER DEVICE

[75] Inventors: Toshio Nishikawa, Nagaokakyo; Youhei Ishikawa; Sadahiro Tamura, both of Kyoto; Haruo Matsumoto, Nagaokakyo, all of Japan

[73] Assignee: Murata Manufacturing Co., Ltd., Kyoto, Japan

[21] Appl. No.: 35,942

[22] Filed: May 4, 1979

[30] Foreign Application Priority Data

| | | | |
|---|---|---|---|
| May 10, 1978 | [JP] | Japan | 53-63173[U] |
| Jun. 22, 1978 | [JP] | Japan | 53-86352[U] |
| Jun. 22, 1978 | [JP] | Japan | 53-76038[U] |
| Jun. 29, 1978 | [JP] | Japan | 53-79668 |

[51] Int. Cl.[3] ..... H01P 1/213; H01P 1/212; H01P 1/205

[52] U.S. Cl. ..... 333/134; 333/206; 333/222

[58] Field of Search ..... 333/126, 134, 206, 222, 333/129

[56] References Cited

U.S. PATENT DOCUMENTS

| | | | |
|---|---|---|---|
| 2,984,798 | 5/1961 | Bryan | 333/134 |
| 3,292,075 | 12/1966 | Wenzel | 333/134 X |
| 3,727,152 | 4/1973 | Bodonyi | 333/135 |
| 4,151,494 | 4/1979 | Nishikawa et al. | 333/206 |
| 4,168,479 | 9/1979 | Rubin | 333/126 |

*Primary Examiner*—Paul L. Gensler

*Attorney, Agent, or Firm*—Ostrolenk, Faber, Gerb & Soffen

[57] ABSTRACT

A filter device has two filters for filtering or separating two high-frequency signals having different frequencies. Each filter comprises a plurality of quarter-wavelength coaxial resonators, cables for connecting the filters with terminals, and a casing for accommodating the two filters. Either the respective input cables or the respective output cables of the two filters are joined in a tee joint. The casing is constituted of two cooperating blocks each having grooves to precisely accommodate the two filters and the cables. The two-part casing maintains the tee joint and obviates the need for a conventional T-shaped metallic coupling member, and makes manufacture very easy.

13 Claims, 15 Drawing Figures

HIGH FREQUENCY FILTER DEVICE

BACKGROUND OF THE INVENTION

The present invention relates to a high frequency filter device having two filter arrangements for filtering or separating two signals having different frequencies.

Generally, the conventional filter device includes two filter arrangements, each having input and output. The inputs of the two filter arrangements are connected to each other and, in turn, to the input terminal of the filter device. On the other hand, the outputs of the two filter arrangements are each connected to a separate output terminal of the filter device.

According to the conventional filter device, the junction in which the inputs of the two filter arrangements and the input terminal are connected is effected by the use of a metallic coupling member, such as a coaxial tee joint of a T-shaped configuration. The use of such coupling member increases not only the size of the high frequency filter device but also its weight.

SUMMARY OF THE INVENTION

Accordingly, it is a primary object of the present invention to provide a high frequency filter device which can be assembled without the employment of such a coupling member as required in the prior art device.

It is also a primary object of the present invention to provide a high frequency filter device of the above described type which is simple in construction and can readily be manufactured at low cost.

It is a further object of the present invention to provide a high frequency filter device of the above described type having an improved standing wave ratio.

In accomplishing these and other objects, a high frequency filter device according to the present invention comprises first and second filter arrangements each having at least one quarter-or half-wavelength coaxial resonator made of dielectric material of a cylindrical shape and being responsive to TEM mode. The first filter arrangement is employed for filtering a first signal and the second filter arrangement is employed for filtering a second signal having a frequency higher than that of the first signal. First and second terminals are connected to one end of the first and second filter arrangements, respectively, while a third terminal is connected to the other ends of the first and second filter arrangements through a common junction. The common junction is the connected to near the end of the first filter arrangement and to the near end of the second filter arrangement by the use of respective first and second cables joined at the junction. The length of the first cable is such that the input second signal applied to the common junction and the second signal reflected from the first filter arrangement match in phase with each other at the common junction, and the length of the second cable is such that the input first signal applied to the common junction and the first signal reflected from the second filter arrangement match in phase with each other at the common junction.

The high frequency filter device according to the present invention further comprises casing means for shielding the first and second filter arrangements. This casing means includes upper and lower blocks, which have matching grooves to accomodate the first and second filter arrangements and first and second cables, the terminals being disposed outside the casing, so that when the upper and lower blocks are fitted together, the cables and the two filter arrangements are accommodated snugly in the grooves and held tightly in place.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DETAILED DESCRIPTION OF THE INVENTION

Figures 1A, 1B:
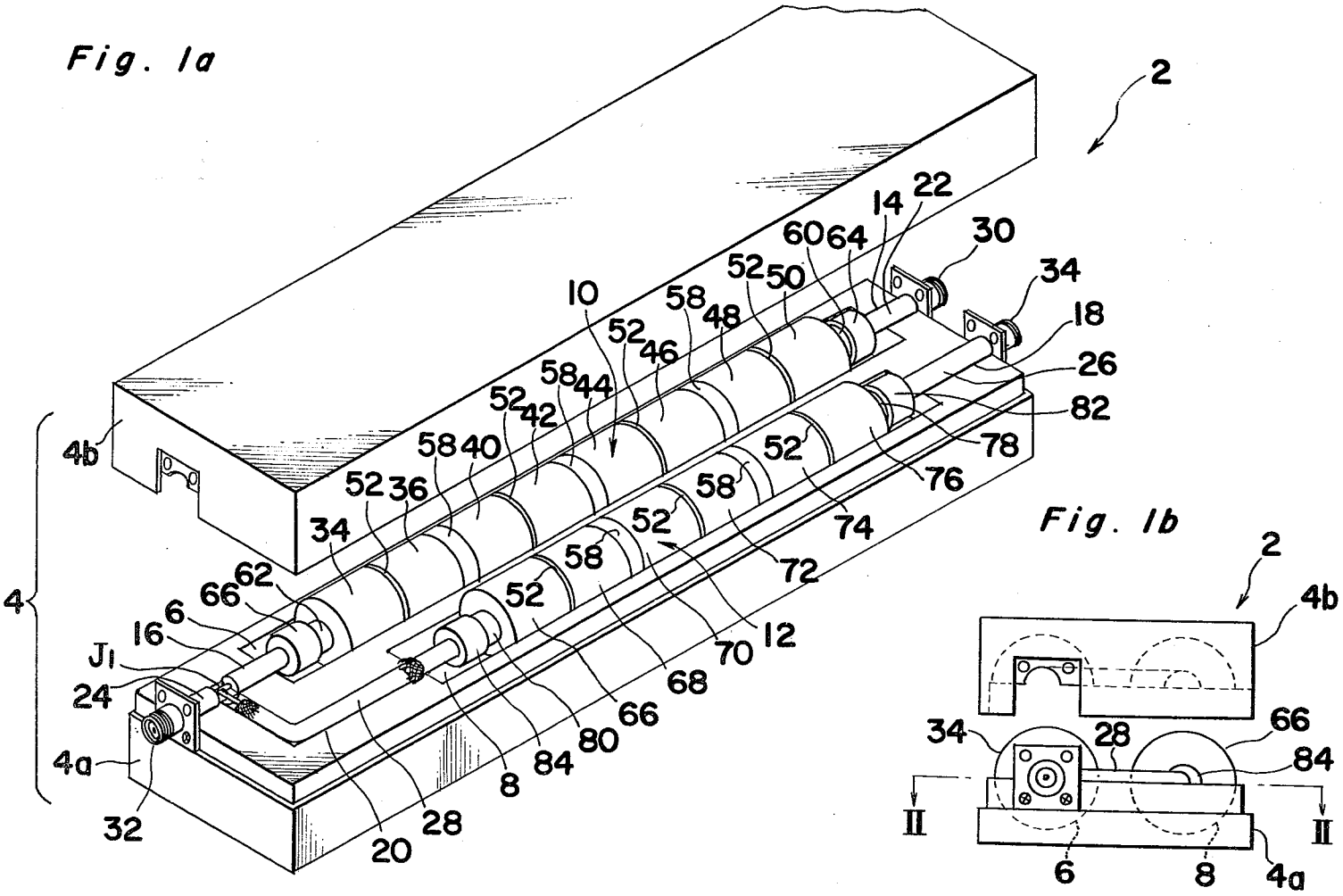
FIG. 1*a* is a perspective view of a high frequency filter with an upper casing block separated from a lower casing block.
FIG. 1*b* is an end view of the high frequency filter shown in FIG. 1*a;*
Figure 12:
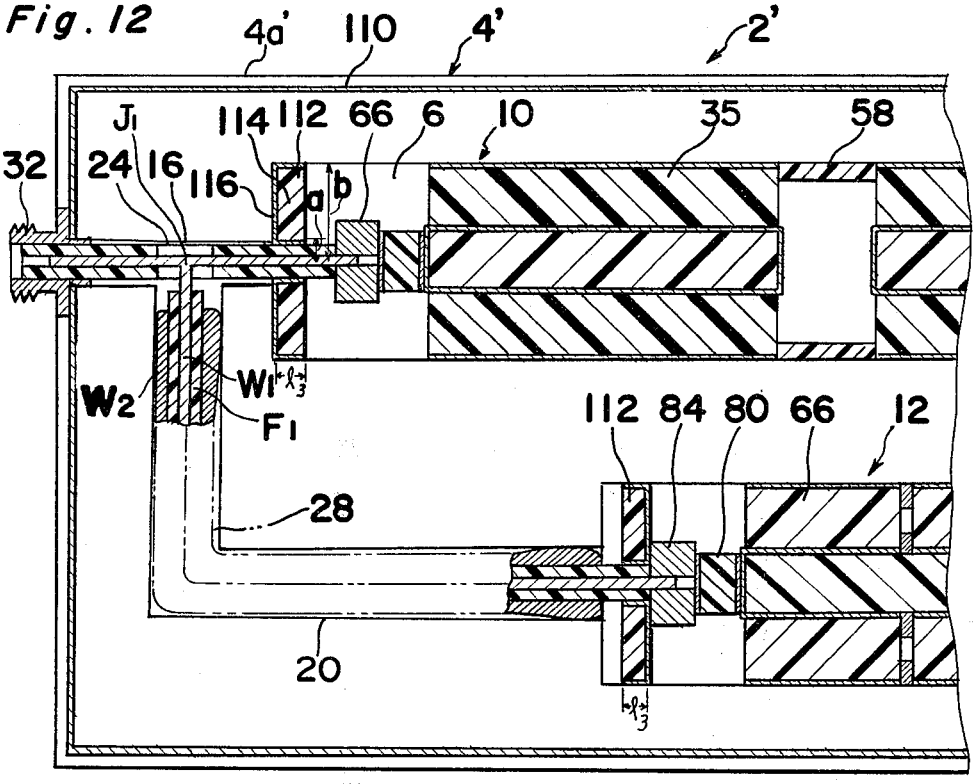
FIG. 12 is a view similar to FIG. 2, but particularly showing another embodiment of the filter.

Referring to FIGS. 1*a* and 1*b*, a high frequency filter device 2 of the present invention comprises a shield casing 4 of an elongated box-like configuration having a base block 4*a* and a lid block 4*b* which are made of conductive material, such as metal, preferably by the use of the known lost wax process. The base block 4*a* has two elongated grooves 6 and 8 of substantially semicircular cross section formed in a longitudinal direction of the base block 4*a* and parallel to each other. The first groove 6, longer than the second groove 8, receives a first filter arrangement 10 while the second groove 8 receives a second filter arrangement 12. The base block 4*a* is further formed with a groove 14 which extends from the right-hand end of the groove 6 as depicted in FIG. 12 to the right-hand end of the base block 4*a*, and a groove 16 which extends from the left-hand end of the groove 6 to the left-hand end of the base block 4*a*. Similarly, grooves 18 and 20 are formed between, respectively, from the right-hand end of the groove 8 to the right-hand end of the base block 4*a* and from the left-hand end of the groove 8 to an intermediate portion of the groove 16. Likewise, matching grooves are formed in the lid block 4*b*.

Figure 2:
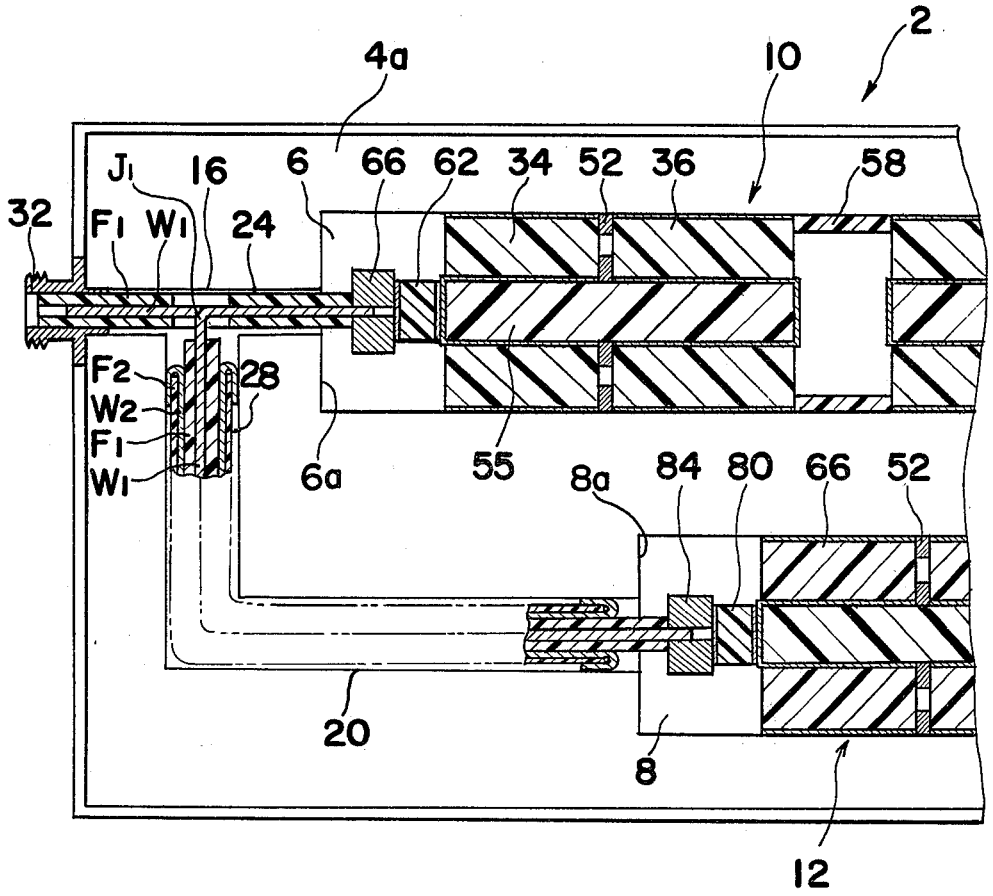
FIG. 2 is a cross sectional view on an enlarged scale of the end portion of the high frequency filter, taken along the line II—II shown in FIG. 1*b;*

These grooves 14, 16, 18 and 20 are provided to accommodate cables extending from the respective ends of each filter arrangement. Grooves 14, 16 and 18 receive respective cables 22, 24, 26, each of which includes an inner conductive wire W1 and an inner insulating tube F1, as best shown in FIG. 2, and groove 20 receives a cable 28 having an inner conductive wire W1, an inner insulating tube F1, an outer conductive wire W2 and an outer insulating tube F2. One ends of each of cables 22 and 24 is connected, respectively to the opposite ends of the first filter arrangement 10 while the other of each is connected, respectively to terminals 30 and 32. Similarly, one end of cable 26 is connected to one end of the second filter arrangement 12 while the other end of the cable 26 is connected to a terminal 34. The terminals 30, 32 and 34 are each constituted by coaxial connecting elements each having inner and outer conductors. Each inner conductor is connected to the inner wire W1 of the corresponding cable while the outer conductor is connected to the shield casing 4. The cable 28, particularly, the inner conductive wire W1 thereof, is connected between the end of the second filter arrangement 12 and the intermediate portion of the cable 24, where the insulating tube F1 of the cable 24 is partly stripped off. This T-formation connection between cable 28 and cable 24 is hereinafter referred to as junction J1. Since the inner conductors W1 joined in the T-formation of cable at the junction J1 are firmly held in place and in their proper shape in the coaxial tee joint by the shape of grooves of 16 and 20 the base and lid blocks, it is not necessary to employ any connecting member at junction J1. The outer conductive wire W2 of cable 28 is grounded by being connected to the casing 4 at both ends.

It is to be noted that the connection of the groove 20 with the groove 16 is so located that the cable length from junction J1 to the respective filter arrangements 10 and 12 may have respective predetermined lengths, to be described later in connection with FIGS. 8 to 11.

Figure 3:
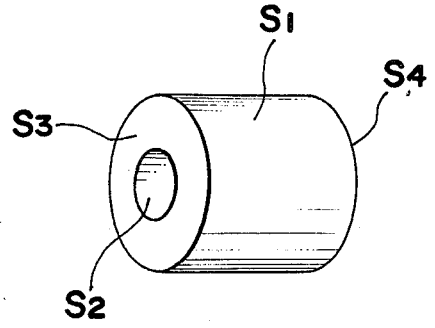
FIG. 3 is a perspective view of one of quarter wavelength coaxial resonators employed in the filter arrangement.

Still referring to FIG. 1*a*, the first filter arrangement 10 comprises a plurality of, for example, eight quarter wavelength TEM mode coaxial resonators 34, 36, 40, 42, 44, 46, 48 and 50 connected in series with each other, each of said resonators comprising a ceramic body. As shown in FIG. 3, each resonator body has an outer curved surface S1, an inner curved surface S2 and opposite annular end faces S3 and S4. The outer curved surface S1 and inner curved surface S2 are coated with respective layers of a conductive material, such as silver paste, which are sintered afterwards.

It is to be noted the ceramic body can be prepared by combining a plurality of bodies. Furthermore, the ratio of the outer radius to the inner radius of the ceramic body should preferably be about 3.6 to obtain the highest possible quality factor.

Each two neighboring resonators, e.g. 34 and 36, are coupled together through a disc-shaped electrode member 52 interposed therebetween to constitute a filter unit.

Figure 5A:
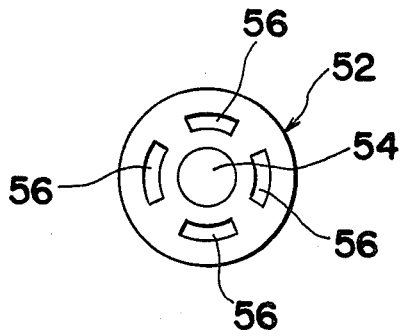
FIG. 5*a* is an end view of a discshaped electrode member
Figure 5B:
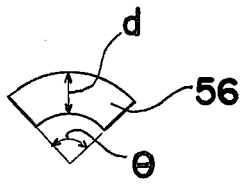
FIG. 5*b* is a schematic diagram showing one of the openings formed in the electrode member shown in FIG. 5*a;*

Referring particularly to FIG. 5*a* and 5*b*, the disc-shaped electrode member 52 has a center opening 54 and a plurality of arcuate openings 56 disposed in a circle around the center opening 54 and spaced an equal angle apart from each other. Each opening 56 has a radial width d and a tangential length equal to an angle $\theta$. The outer and inner diameters of such electrode member 52 are the same as those of the cylindrical resonators.

In each filter unit, a rod 55 (see FIG. 2) made of the same dielectric material as the resonators is rigidly inserted through the bore of the resonators and of the electrode member 52. The opposite end faces of the rod 55 are laminated with silver paste (see FIGS. 2 and 12) which is sintered afterwards. This can be accomplished by inserting the rod 55 through the bore of the filter unit, then applying a silver paste to the opposite end faces of the rod 55 and finally sintering the applied silver paste. For holding the electrode member 52 firmly in place in contact with and between the resonators, a heat-resistant adhesive made of an inorganic material, such as a glaze or a silicone compound, is applied therebetween.

Figure 4:
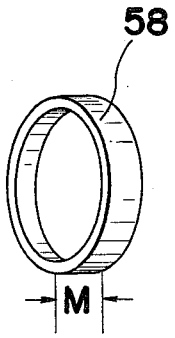
FIG. 4 is a perspective view of one of spacer members to be put between the neighboring resonators.

The two neighboring filter units are spaced a predetermined distance from each other by a ring-shaped spacer, shown in FIG. 4, which is made of dielectric material having a low dielectric constant, such as forsterite. The width M of the spacer 58 is selected to provide optimum coupling.

Resonators separated by an electrode member 52 are coupled together inductively, whereas resonators separated by a spacer ring 58 are coupled together capacitively. It is to be noted that each spacer 58 is not limited to a ring shape, but may have any other shape and any size, as long as the two filter units it separates are coupled capacitively. From this point of view, it is not necessary to employ any solid material between the filter units at all. It is sufficient to provide an air gap of a predetermined size between the filter units.

The first filter arrangement 10 further includes a disc-shaped coupling capacitor 60 and 62 and an offset terminal 64, 66 at each end of the filter unit 10. Each of the offset terminals 64 and 66 is made of a conductive material such as metal and has a cylindrical shape with an axial bore. The bore is provided for connecting the inner conductive wire W1 with the corresponding coupling capacitor by inserting the wire W1 into the bore. It is preferable to apply an electrically conductive bonding agent or to deposit solder between the wire W1 and the offset terminal to secure the connection therebetween.

When a signal is propagated through the quarter-wavelength resonator 34, the propagated signal shows the highest voltage at the left-hand end face of the resonator 34 in the first filter arrangement 10, and the lowest voltage at the right-hand end face of the resonator 34. Therefore, from the view point of signal propagation through the first filter arrangement 10, the left-and right-hand end faces of the resonator 34 as aligned in the manner as shown in FIG. 1*a* correspond to an open-ended port and a closed-ended port, respectively. In a similar manner, the left and right hand end faces of the resonator 36 as aligned in the manner as shown in FIG. 1*a* correspond to a closed-ended port and an open ended port, respectively. According to the embodiment shown in FIG. 1*a* in which the quarter wavelength resonators are employed, each two quarter-wavelength resonators having their short-ended port faces adjacent to each other, such as resonators 34 and 36, are coupled inductively, while each two neighboring quarter-wavelength resonators having their open-ended port faces adjacent to each other, such as resonators 36 and 40, are coupled capacitively.

It is possible to replace the two quarter-wavelength resonators 34 and 36 with a half-wavelength resonator 35, as particularly shown in FIG. 12. In this case, both end faces of the half-wavelength resonator 35 correspond to open-ended ports. Futhermore, it is possible to replace the two quarter-wavelength resonators 36 and 40 with a half-wavelength resonator (not shown). In this case, both end faces of the half wavelength resonator correspond to closed-ended ports. Moreover, the left-hand end of the filter arrangement 10 can be made to correspond to a close-ended port by replacing coupling capacitor 62 with a coupling inductor.

The second filter arrangement 12 comprises six quarter-wavelength resonators 66, 68, 70, 72, 74 and 76, which are connected in the same manner as the resonators of the first filter arrangement 10 by employment of the disc-shaped electrode members 52, spacer rings 58 and rods 55. The second filter arrangement 12 further comprises a coupling capacitor 78, 80 at each end of the second filter arrangement 12 and offset terminals 82 and 84 for the connection of the cables 26 and 28 with the respective capacitors 78 and 80. Since the second filter arrangement 12 is similar in construction to the first filter arrangement 10, detailed description thereof is omitted for the sake of brevity.

It is, however, to be noted that the size of each resonator and the number of such resonators employed in each filter arrangement are chosen so as to exhibit the desired filtering frequency and selectivity. According to the embodiment shown, the first filter arrangement 10 filters a signal having a central frequency f1 while the second filter arrangement 12 filters a signal having a central frequency f2 higher than the central frequency f1. After the first and second filter arrangements are assembled in the manner described above, the lid block **4*b* is placed over the base block 4*a* and secured in position by means of a bonding agent or screws, to secure the elements contained in the casing 4** firmly in place.

When the high frequency filter device 2 of the present invention is in use, the signal may be applied to the terminals 30 and 34 and taken out from the terminal 32, or may be applied to the terminal 32 and taken out from the terminals 30 and 34, as is convenient. The description hereinafter is particularly given with respect to the latter case.

When two signals having frequencies f1 and f2 are applied to the terminal 32, they are transmitted to the junction J1 and to the offset terminals 66 and 84. The first signal, having the central frequency f1, is able to pass through the first filter arrangement 10, while the second signal having the central frequency f2, is reflected therefrom. The reflected signal is combined with the incoming signals and, as a consequence, is applied to the second filter arrangement together with the incoming signals. In order to prevent the incoming second signal from being disturbed by the reflected second signal, it is necessary to match the phase of the newly incoming second signal with that of the reflected second signal. For this purpose, the length of the cable from junction J1 to the offset terminal 66 is carefully selected in consideration of the frequency of the second signal.

For the same reason, the length of the cable 28, that is the distance from junction J1 to offset terminal 84, also has a carefully selected relation of the frequency of the first signal. That relation will be described in detail with reference to FIGS. 8 to 11.

Figure 8:
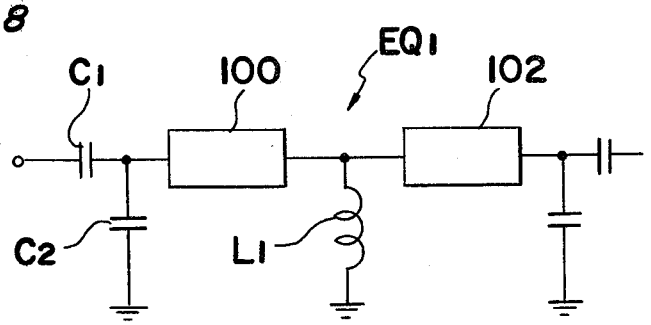
FIG. 8 is a circuit diagram showing an equivalent circuit of the first filter arrangement viewed from a coupling capacitor.

Referring to FIG. 8, there is shown an equivalent circuit EQ1 which corresponds to a portion of the first filter arrangement 10 viewed from the coupling capacitor 62. In the equivalent circuit EQ1, capacitors C1 and C2 indicate the capacitance of capacitor 62 and the floating capacitance around capacitor 62, respectively. Blocks 100 and 102 indicate distributed constant lines resulting from the employment of the resonators 34 and 36, respectively. An inductor L1 indicates an inductance resulting from the employment of the plate electrode member 52.

Figure 9:
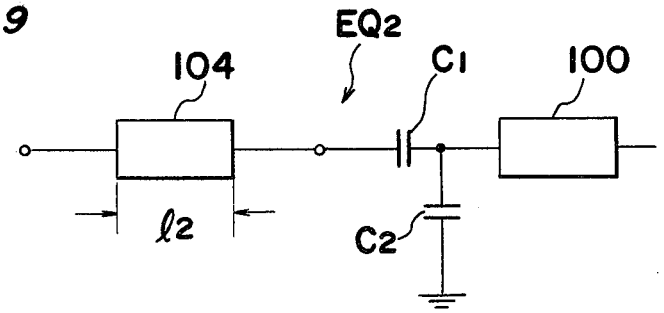
FIG. 9 is a circuit diagram showing an equivalent circuit of the first filter arrangement viewed from junction J1 of FIG. 1*a;*
Figure 10:
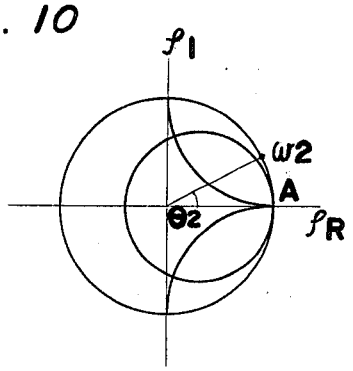
FIGS. 10 and 11 are Smith impedance charts showing respective impedance characteristics of the first and second filter arrangements.

Referring to FIG. 9, there is shown an equivalent circuit EQ2 which corresponds to a portion of the first filter arrangement 10 viewed from the junction J1. In the equivalent circuit EQ2, a block 104 indicates a distributed constant line resulting from the employment of the cable 24 extending between the junction J1 and the coupling capacitor 62. In FIG. 9, reference character $l_2$ indicates the actual length of the cable 24 between the junction J1 and the end surface **6*a* of the groove 6 (see FIG. 2). If the filter 10 is electrically in the open state with respect to the second signal as viewed from the junction J1, it is understood that the reflected second signal and the incoming signal will match at the junction J1. FIG. 10 is a Smith impedance chart showing an impedance characteristic of the second signal at the end surface 6*a*. As is apparent from the chart of FIG. 10, the second signal, expressed by angular frequency $\omega_2$, is in the inductive region. Angle $\theta_2$ in FIG. 10 indicates the phase difference at the end surface 6*a* between the reflected second signal and the incoming signal and is related to the actual length $l_2$ of the cable 24 between the junction J1 and the end surface 6*a*** as follows:

$$l_2=\theta_2/4\pi\cdot\lambda_{02} \quad (1)$$

wherein $\lambda_{02}$ is the wavelength of the second signal. Since the length $l_2$ is equal to $\theta_2/\pi$ times $\lambda_{02}/4$, and since $\theta_2/\pi$ is smaller than 1, the length $l_2$ is smaller than $\lambda_{02}/4$. For example, when the second signal has a frequency of 800 MHz, the length $l_2$ is about 2 to 3 mm. whereas the angle $\theta_2$ is about 20° to 30°.

Figure 11:
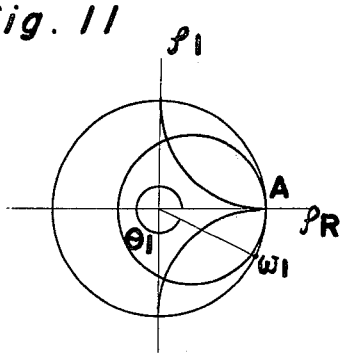

Similar equivalent circuits can be given for the second filter arrangement 12. If the filter 12 is electrically in the open state with respect to the first signal as viewed from the junction J1, the reflected first signal at the second filter 12 and the incoming first signal will match at the junction J1. FIG. 11 is a Smith impedance chart showing an impedance characteristic of the first signal at the end surface **8*a* of the groove 8. In this chart, the first signal, expressed by angular frequency $\omega_1$, is in the capacitive region. Angle $\theta_1$ in FIG. 11 indicates the phase difference at the end surface 8*a* between the reflected first signal and the incoming signal and is related to the actual length $l_1$ of the cable 28 between the junction J1 and the end surface 8*a*** as follows:

$$l_1=\theta_1 4\pi\cdot\lambda_{01} \quad (2)$$

wherein $\lambda_{01}$ is the wavelength of the first signal. Since the length $l_1$ is equal to $\theta_1/\lambda$ times $\lambda_{01}/4$, and since $\theta_1/\pi$ is larger than 1, the length $l_1$ is larger than $\lambda_{01}/4$. Furthermore, the length $l_1$ is smaller than $\lambda_{01}/2$ and, therefore, length $l_1$ is longer than length $l_2$, that is, the length of the cable 28 between the junction J1 and the end surface **8*a* is greater than that of the cable 24 between the junction J1 and the end surface 6*a***.

It is not necessary to arrange the intermediate portion of the cable 28 in the L-shaped shown in the preferred embodiment; it may be in any suitable shape, such as an S-shape, so long as the cable 28 has the length described above and both ends of the outer conductive wire W2 are grounded by being connected to the shield casing. According to the preferred embodiment, the cable 28 is on the semi-rigid type and is caulked in the groove 20, offering a rigid structure. The grounding of the outer wire W2 to the casing 4 and the grounding of the outer segments of the terminals 30, 32 and 34 to the casing 4 eliminates the need for a further connection between the outer wire W2 and the respective terminals.

Figure 6:
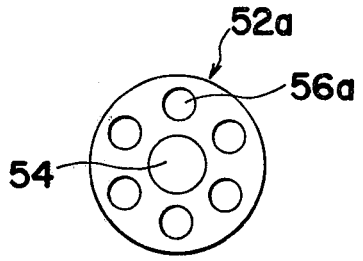
FIGS. 6 and 7 are sectional end views showing modifications of the disc-shaped electrode member.

Referring to FIG. 6, there is shown a plate electrode member 52*a* which is a modification of the plate electrode member 52 shown in FIG. 5*a*. The plate electrode member 52*a* in this modification has six circular openings 56*a* instead of the arcuate openings 56 shown in FIG. 5. It is to be noted that the circular openings 56*a* are equidistant from the center of the disc-shaped plate 52*a*, and that the neighboring centers of circular openings 56*a* are separated from each other by an angle of 60° about the center of the plate 52*a*.

Figure 7:
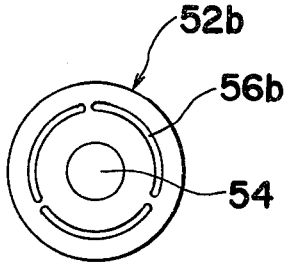

Referring to FIG. 7, there is shown a plate electrode member 52*b* which is another modification of the plate electrode member 52 shown in FIG. 5*a*. The plate electrode member 52*b* in this modification has 3 arcuate slots 56*b* which are equidistant from the center of the disc-shaped plate 52*b* and are equally spaced from each other.

It is to be noted that the pattern of the openings 56 or 56*a* or 56*b* is not limited to those described above; any other pattern may be employed so long as the openings are symmetrically disposed about the center of the disc-shaped plate. According to the preferred embodiment, the pattern of the openings 56 or 56*a* or 56*b* is such that the rotation of the disc about the center thereof through 90°, 60° or 120°, respectively, results in exactly the same alignment as before the rotation. This requirement is necessary because the microwave signal propagated through the filter arrangement is in a TEM mode which is symmetric about the axis of the cylindrical resonator. Therefore, such a symmetrical pattern of the openings, has the advantage of enabling the dominant mode to propagate while spurious modes are cut off. Furthermore, such a symmetrical pattern of the openings facilitates the calculation of the coupling coefficient between the resonators and enables the optimum coupling coefficient to be attained.

It is to be noted that the plate electrode member 52 can be formed by printing silver paste in a predetermined pattern, or by removing portions of a layer of printed silver paste in a predetermined pattern through the step of photo-etching.

Referring to FIG. 12, there is shown another embodiment 2′ of the high frequency filter device of the present invention. The high frequency filter device 2′ of this embodiment comprises the shield casing 4′ having base block 4*a*′ and lid block 4*b*′, (not shown) each made of plastic with a metal film 110, e.g. of a Ni-Cr compound, laminated on entire inner surface of the casing, including grooves, by means of plating. The outer conductive wire W2 of the cable 28 is electrically connected to the metal film 110 for the purpose of grounding. The outside surface of the casing 4′ is also laminated with metal film, for the purpose of shielding. The high frequency filter device 2′ further comprises a ring-shaped auxiliary resonator 112 mounted on the cable 24 in a space between the offset terminal 66 and the end of the groove 6 preferably, the ring-shaped resonator 112 is held in contact with the left-hand end of the groove 6. This resonator 112 is a quarter-wavelength coaxial resonator and includes a ring-shaped ceramic body 114 of dielectric material and a film 116 of conductive material laminated on the inner and outer curved surfaces of the ring-shaped ceramic and on one flat surface, which latter is in contact with the end of the groove 6. Conductive layer 116 is provided for the purpose of connection with the shield casing. The resonator 112 is responsive to the 3(2N-1)th harmonic, that is, the harmonic whose frequency is 3(2N-1) times the fundamental frequency of the resonator 34, N being an integer. For example, the resonator 112 is responsive to the third harmonic, which has frequency 3fo, fo being the fundamental frequency of the resonator 34.

In a similar manner, a similar auxiliary resonator 112 can be applied to the other end of the first filter arrangement 10 and also to each end of the second filter arrangement 12. Furthermore, instead of positioning the auxiliary resonator 112 in contact with the left-hand end of the groove 6 as described above, it may be mounted on the cable immediately adjacent to the offset terminal to connect the conductive layer 116 with the offset terminal. Such an auxiliary resonator 112 forms a wave trap for removing spurious modes without causing deterioration of the propagation characteristic of the signal of fundamental frequency.

Figure 13:
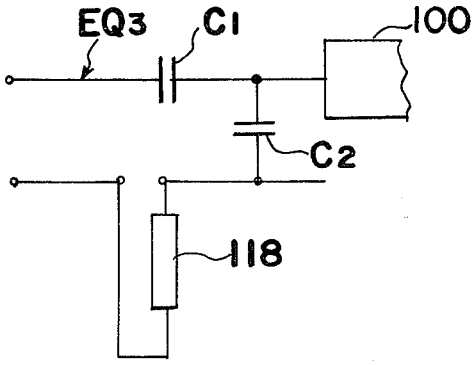
FIG. 13 is a circuit diagram showing an equivalent circuit of the first filter arrangement of FIG. 12 viewed from a junction.

Referring to FIG. 13, there is shown an equivalent circuit EQ3 which corresponds to a portion of the first filter arrangement 10 viewed from the auxiliary resonator 112. In the equivalent circuit EQ3, a block 118 indicates a wave trap resulting from the presence of the resonator 112.

The actual length $l_3$ in the axial direction of the auxiliary resonator 112 can be given as follows:

$$l_3 = \frac{\lambda_{(3fo)}}{4\sqrt{\epsilon_r}} \tag{3}$$

in which $\epsilon_r$ is the dielectric constant of the ceramic body 114 of the resonator 112. The characteristic impedance Zo of the auxiliary resonator 112 can be given as follows:

$$Zo = \frac{60}{\sqrt{\epsilon_r}} \log_e \frac{b}{a} \tag{4}$$

in which a and b are the inner and outer radii of the ceramic body 114, respectively. For example, when the dielectric constant $\epsilon_r$ is 36 and the fundamental frequency fo is 850 MHz, the third harmonic will have a frequency of 2,550 MHz and, the actual length $l_3$ will be about 4.9 mm. When the inner and outer radii of the ceramic body 114 are such as to give the ceramic body 114 a characteristic impedance of 12 Ω, the reactance with respect to the fundamental frequency becomes inductive. The inductance in this case can be expressed as follows:

$$L_{(fo)} \simeq \frac{Zo}{\omega_{(fo)}} \tan \phi \tag{5}$$

in which $\phi$ is the electrical angle. Since the electrical angle $\phi_{(3fo)}$ at the frequency 3fo can be expressed as follows:

$$\phi_{(3fo)} = \frac{\pi}{2} = \frac{2}{\lambda_{(3fo)}} \sqrt{\epsilon_r}\ l_3 \quad (6)$$

the electrical angle $\phi_{(fo)}$ at the frequency fo can be expressed as follows:

$$\phi_{(fo)} = \frac{2\pi}{3\lambda_{(3fo)}} \sqrt{\epsilon_r}\ l_3 = \frac{\pi}{6} \quad (7).$$

Therefore, the inductance L at the frequency fo can be expressed as follows:

$$L_{(fo)} \simeq \frac{Zo}{\omega_{(fo)}} \tan\frac{\pi}{6} \quad (8).$$

Since, according to the present invention, the high frequency filter 2' includes the auxiliary resonator 112 which is responsive to the signal having frequency 3fo, the characteristic impedance Zo can be made small in comparison with that of the quarter-wavelength coaxial resonator which is responsive to the signal of frequency 3fo, but which has no ceramic body 114. When the characteristic impedance is small, the resonator inductance with respect to the frequency fo becomes small, and thus the reactance thereof becomes small. Therefore, the use of such a resonator 112 causes no appreciable deterioration in the signal propagation. When such a resonator 112 is employed, it is preferable to adjust the capacitance of the coupling capacitor 66.

It is to be noted that the resonator 112 may be one responsive to other harmonics than the third harmonic, so long as the harmonic has a frequency which is 3(2N-1) times the fundamental frequency, N being an integer. Furthermore, a plurality of auxiliary resonators can be mounted on each end of the filter arrangement 10 or 12.

Many further variations of the preferred embodiments are possible. For example, the conductive layer laminated on the exterior of the plastic casing 4 can be replaced by a wire mesh embedded in the casing.

Since the high frequency filter device of the present invention has the casing 4 divided into the base block **4*a* and the lid block 4*b*, assembly of the elements in the casing 4** can be carried out simply and the number of such elements can be considerably reduced. Moreover, the outer conductive layer of each resonator and the inner conductive surface of the casing can be held in contact with each other at any desired number of places.

Since the grooves 6 and 8 receive the resonators in a row while the spacer rings separate neighboring resonators precisely by a predetermined distance, the resonators can be positioned at the required places without any difficulty.

Furthermore, since the casing itself forms a cavity or coaxial tee joint for the high frequency signals, it is not necessary to employ any coaxial tee joint at the junction J1.

Although the present invention has been fully described with reference to several preferred embodiments many modifications and variations thereof will now be apparent to those skilled in the art, and the scope of the present invention is therefore to be limited not by the details of the preferred embodiments described above, but only by the terms of the appended claims.

What is claimed is:

1. A filter device comprising:

a first filter arrangement responsive to a TEM mode and employed for filtering a first signal having a first frequency; said first filter arrangement comprising at least one coaxial resonator of cylindrical shape and made of a dielectric material; said coaxial resonator having a length equal to m times one-quarter of the wavelength in said dielectric material at said first frequency, in being a positive integer less than three;

a second filter arrangement responsive to a TEM mode and employed for filtering a second signal having a second frequency different from said first frequency; said second filter arrangement comprising at least one coaxial resonator of cylindrical shape and made of a second dielectric material; said coaxial resonator having a length equal to n times one-quarter of the wavelength in said second dielectric material at said second frequency, n being a positive integer less than three;

a first terminal connected to one end of said first filter arrangement by means of a first cable;

a second cable connecting one end of said second filter arrangement to a portion of said first cable intermediate said first terminal and said one end of said first filter arrangement, and forming a junction with said first cable thereat; the length of said first cable between said junction and said one end of said first filter arrangement being such that a portion of said second signal reflected from said first filter arrangement will match in phase another portion of said second signal appearing at said junction, and the length of said second cable between said junction and said one end of said second filter arrangement being such that a portion of said first signal reflected from said second filter arrangement will match in phase another portion of said first signal appearing at said junction.

2. A filter device as claimed in claim 1, wherein said first filter arrangement further comprises an auxiliary resonator and disposed at one end of said first filter arrangement and coaxial therewith; said auxiliary resonator having an axial length such as will enable it to trap an unwanted signal of spurious mode which is a 3(2N-1)th harmonic of said first signal, wherein N is an integer.

3. A filter device as claimed in claim 1, wherein said second filter arrangement further comprises an auxiliary resonator comprising a dielectric body and disposed at one end of said second filter arrangement and coaxial therewith; said auxiliary resonator having an axial length such as will enable it to trap an unwanted signal of spurious mode which is a 3(2N-1)th harmonic of said second signal, wherein N is an integer.

4. A filter device as claimed in claim 1, wherein the length of said first cable between said junction and said one end of said first filter arrangement is less than the length of said second cable between said junction and said one end of said second filter arrangement.

5. A filter device as claimed in claim 1, wherein each of said coaxial resonators comprises a cylinder of one of said dielectric materials, said cylinder having a bore, and first and second electrode layers disposed, respectively, on the outer surface of said cylinder and on the surface of said bore.

6. A filter device as claimed in claim 1, further comprising:

casing means accommodating said first and second filter arrangements and said first and second cables; said casing means comprising first and second cooperating blocks; said first block having a first surface and said second block having a second surface, said surfaces having grooves thereon for accommodating snugly and stationarily therein said first and second filter arrangements and said first and second cables.

7. A filter device as claimed in claim 6, wherein said cooperating blocks are made of plastic and further comprises a layer of electrically conductive material laminated over the entire surface, including said grooves, of each of said cooperating blocks.

8. A filter device as claimed in claim 6, wherein said cooperating blocks are made of electrically conductive material.

9. A filter device as claimed in claim 7, wherein the portion of said layer of electrically conductive material which covers the outer surface of said blocks is wire mesh embedded in each of said blocks, for shielding the first and second filter arrangements.

10. A filter device as claimed in claim 1, or claim 6 wherein said first filter arrangement comprises an even number of said resonators, said resonators being identical to each other and being connected in series; said resonators being grouped in pairs, and the two resonators of each pair being inductively coupled exclusively to each other; and each resonator being coupled capacitively to each other resonator which is adjacent to it and to which it is not coupled inductively.

11. A filter device as claimed in claim 10, wherein each of said capacitive couplings is achieved by means of a ring member of a dielectric material being placed coaxially with and between the two of said resonators that it couples.

12. A filter device as claimed in claim 10, wherein each of said inductive couplings is achieved by means of a conductive disc-shaped plate having a plurality of openings formed therein in a rotationally symmetrical pattern with respect to the center of said plate; said plate being coaxially placed between the two of said resonators which it couples.

13. A filter device as claimed in claim 12, wherein said disc-shaped plate is bonded to said resonators which it couples by means of an inorganic bonding agent.

* * * * *